US005560068A

United States Patent [19]

Blake

[11] Patent Number: 5,560,068

[45] Date of Patent: Oct. 1, 1996

[54] FOOT CARE SHOWER BRUSH

[76] Inventor: Emory Blake, 2530 Crawford Dr., Sanford, Fla. 32771

[21] Appl. No.: 499,056

[22] Filed: Jul. 6, 1995

[51] Int. Cl.[6] ..... A47L 13/12

[52] U.S. Cl. ..... 15/106; 15/105; 15/160; 15/172

[58] Field of Search ..... 15/106, 110, 112, 15/113, 161, 160, 116.2, 105, 172

[56] References Cited

U.S. PATENT DOCUMENTS

| | | | |
|---|---|---|---|
| 668,993 | 2/1901 | Le Compte | 15/113 |
| 2,631,316 | 3/1953 | Heller | 15/160 |
| 2,879,532 | 3/1959 | Szabo et al. | 15/114 |
| 2,897,525 | 8/1959 | Goodwin et al. | 15/114 |
| 3,409,926 | 11/1968 | Martin | 15/114 |
| 3,531,814 | 10/1970 | Safalow | 15/114 |
| 4,919,117 | 4/1990 | Muchisky et al. | 15/28 |
| 4,961,733 | 10/1990 | Joseph et al. | 15/114 |
| 5,163,200 | 11/1992 | Carlin et al. | 15/114 |
| 5,444,888 | 8/1995 | Withey | 15/114 |
| 5,479,673 | 1/1996 | Carton | 15/114 |

FOREIGN PATENT DOCUMENTS

| | | | |
|---|---|---|---|
| 0532338 | 11/1928 | Germany | 15/114 |

*Primary Examiner*—David Scherbel
*Assistant Examiner*—James F. Hook

[57] ABSTRACT

A brush for cleaning various portions of a human foot. The inventive device includes an elongated handle for manual manipulation by an individual. A cylindrical brush extends from a lower end of the handle for cleaning between toes of a human foot. An abrasion pad is pivotally mounted to the lower end of the handle and can be extended therefrom for abrading surfaces of the foot. A planar brush is similarly mounted to the handle and can be extended for brushing exterior surfaces of the foot to improve podiatric hygiene.

1 Claim, 3 Drawing Sheets

FOOT CARE SHOWER BRUSH

BACKGROUND OF THE INVENTION

1. Field of the Invention

The present invention relates to personal hygiene devices and more particularly pertains to a foot care shower brush for cleaning various portions of a human foot.

2. Description of the Prior Art

The use of personal hygiene devices is known in the prior art. More specifically, personal hygiene devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art personal hygiene devices include U.S. Pat. No. 5,321,867; U.S. Pat. No. 5,109,553; U.S. Pat. No. 4,759,091; U.S. Pat. No. 5,181,621; U.S. Des. Pat. No. 336,198; and U.S. Des. Pat. No. 298,291.

While these devices fulfill their respective, particular objectives and requirements, the aforementioned patents do not disclose a foot care shower brush for cleaning various portions of a human foot which includes an elongated handle for manual manipulation by an individual, a cylindrical brush extending from a lower end of the handle for cleaning between toes of a human foot, an abrasion pad pivotally mounted to the lower end of the handle for abrading surfaces of the foot, and a planar brush pivotally mounted to the handle for brushing exterior surfaces of the foot to improve podiatric hygiene.

In these respects, the foot care shower brush according to the present invention substantially departs from the conventional concepts and designs of the prior art, and in so doing provides an apparatus primarily developed for the purpose of cleaning various portions of a human foot.

SUMMARY OF THE INVENTION

In view of the foregoing disadvantages inherent in the known types of personal hygiene devices now present in the prior art, the present invention provides a new foot care shower brush construction wherein the same can be utilized for cleaning portions of a human foot. As such, the general purpose of the present invention, which will be described subsequently in greater detail, is to provide a new foot care shower brush apparatus and method which has many of the advantages of the personal hygiene devices mentioned heretofore and many novel features that result in a foot care shower brush which is not anticipated, rendered obvious, suggested, or even implied by any of the prior art personal hygiene devices, either alone or in any combination thereof.

To attain this, the present invention generally comprises a brush for cleaning various portions of a human foot. The inventive device includes an elongated handle for manual manipulation by an individual. A cylindrical brush extends from a lower end of the handle for cleaning between toes of a human foot. An abrasion pad is pivotally mounted to the lower end of the handle and can be extended therefrom for abrading surfaces of the foot. A planar brush is similarly mounted to the handle and can be extended for brushing exterior surfaces of the foot to improve podiatric hygiene.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new foot care shower brush apparatus and method which has many of the advantages of the personal hygiene devices mentioned heretofore and many novel features that result in a foot care shower brush which is not anticipated, rendered obvious, suggested, or even implied by any of the prior art tool guides, either alone or in any combination thereof.

It is another object of the present invention to provide a new foot care shower brush which may be easily and efficiently manufactured and marketed.

It is a further object of the present invention to provide a new foot care shower brush which is of a durable and reliable construction.

An even further object of the present invention is to provide a new foot care shower brush which is susceptible of a low cost of manufacture with regard to both materials and labor, and which accordingly is then susceptible of low prices of sale to the consuming public, thereby making such foot care shower brushes economically available to the buying public.

Still yet another object of the present invention is to provide a new foot care shower brush which provides in the apparatuses and methods of the prior art some of the advantages thereof, while simultaneously overcoming some of the disadvantages normally associated therewith.

Still another object of the present invention is to provide a new foot care shower brush for cleaning various portions of a human foot.

Yet another object of the present invention is to provide a new foot care shower brush which includes an elongated handle for manual manipulation by an individual, a cylindrical brush extending from a lower end of the handle for cleaning between toes of a human foot, an abrasion pad pivotally mounted to the lower end of the handle for abrading surfaces of the foot, and a planar brush pivotally mounted to the handle for brushing exterior surfaces of the foot to improve podiatric hygiene.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
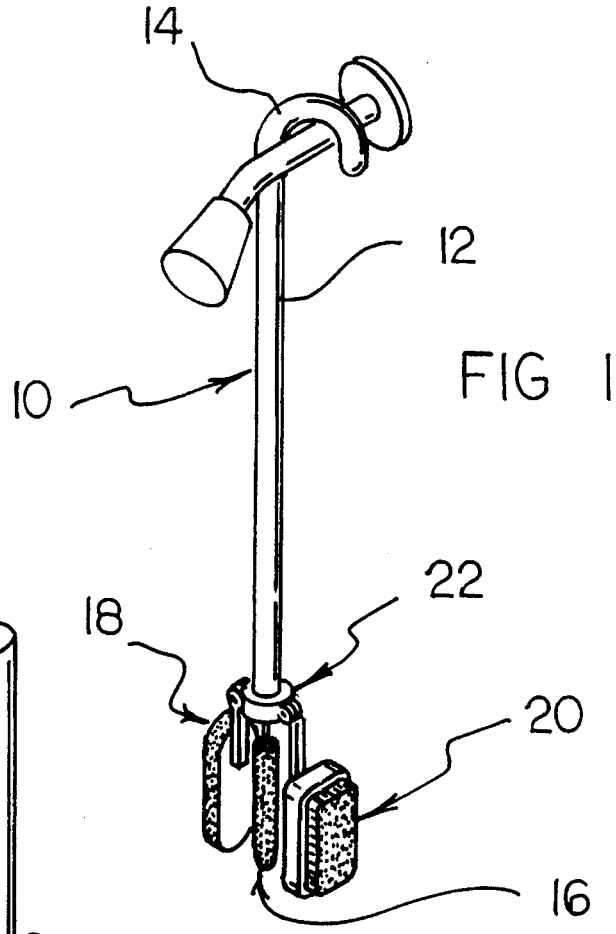
FIG. 1 is an isometric illustration of a foot care shower brush according to the present invention.

With reference now to the drawings, and in particular to FIGS. 1–5 thereof, a new foot care shower brush embodying the principles and concepts of the present invention and generally designated by the reference numeral 10 will be described.

More specifically, it will be noted that the foot care shower brush 10 comprises an elongated handle 12 for being grasped and manually manipulated by an individual during use of the device 10. The elongated handle 12, as shown in FIG. 1, may include a suspension hook 14 mounted at an upper end thereof permitting suspension of the entire device 10 from a support projection such as a shower head or the like. The elongated handle 12 includes a lower end from which a cylindrical brush 16 projects for cleaning between adjacent toes of a human foot. An abrasion pad 18 is pivotally mounted to the lower end of the elongated handle 12 and can be utilized for abrasively cleaning exterior portions of a human foot. Similarly, a planar brush 20 is pivotally mounted to the lower end of the elongated handle 12 and can be utilized for brushing exterior portions of the human foot as desired by an end user. By this structure, both abrasion and brushing of various portions of the human foot can be accomplished so as to improve podiatric hygiene.

Figure 2:
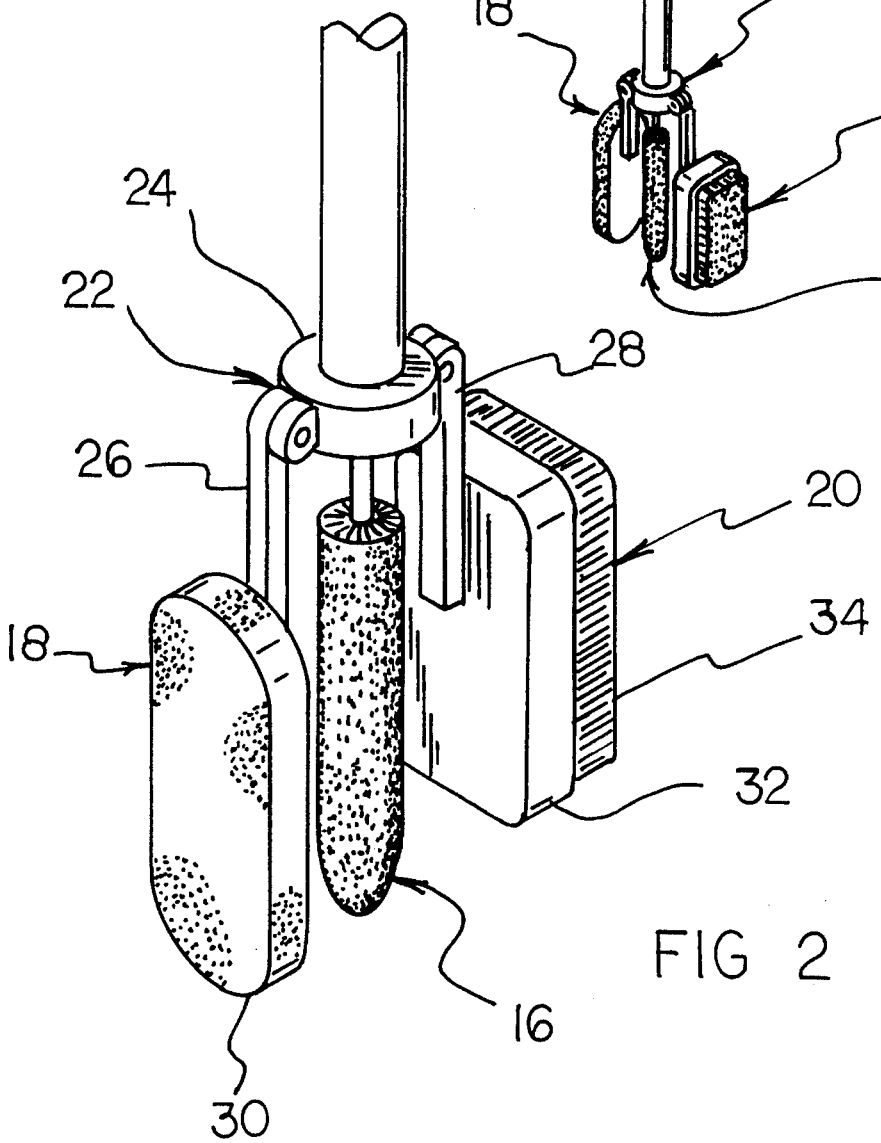
FIG. 2 is an enlarged isometric illustration of a portion of the present invention.
Figure 3:
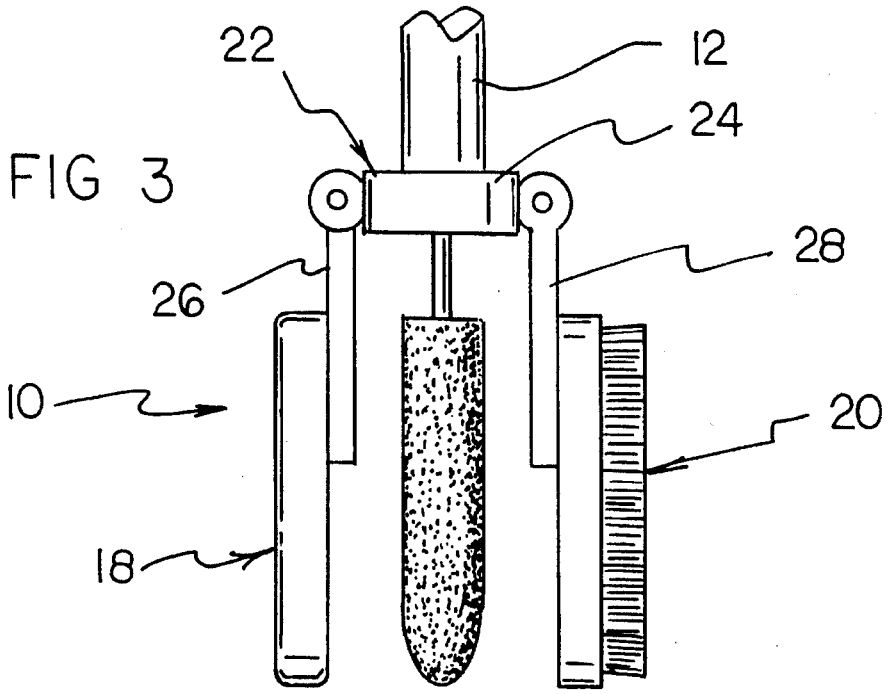
FIG. 3 is an elevation view of a portion of the present invention in a first position.

Referring now to FIGS. 2 through 5 wherein the present invention 10 is illustrated in detail, it can be shown that the abrasion pad 18 and the planar brush 20 are pivotally mounted to the lower end of the elongated handle 12 by a pivotal mounting means 22. To this end, the pivotal mounting means 22 preferably comprises a mounting boss 24 secured to the lower end of the elongated handle 12. A first arm 26 is pivotally mounted to the mounting boss 24 and extends therefrom to couple with the abrasion pad 18. Similarly, a second arm 28 is pivotally mounted to the mounting boss 24 in a diametrically opposed orientation relative to the first arm 26 and extends from the mounting boss 24 to couple with the planar brush 20. By this structure, either or both of the abrasion pad 18 and the planar brush 20 can be pivoted below the lower end of the elongated handle 12, as shown in FIG. 3 of the drawings, for use during a cleaning procedure, or alternatively pivoted above the lower end of the handle 12 during periods of non-use thereof.

Figure 4:
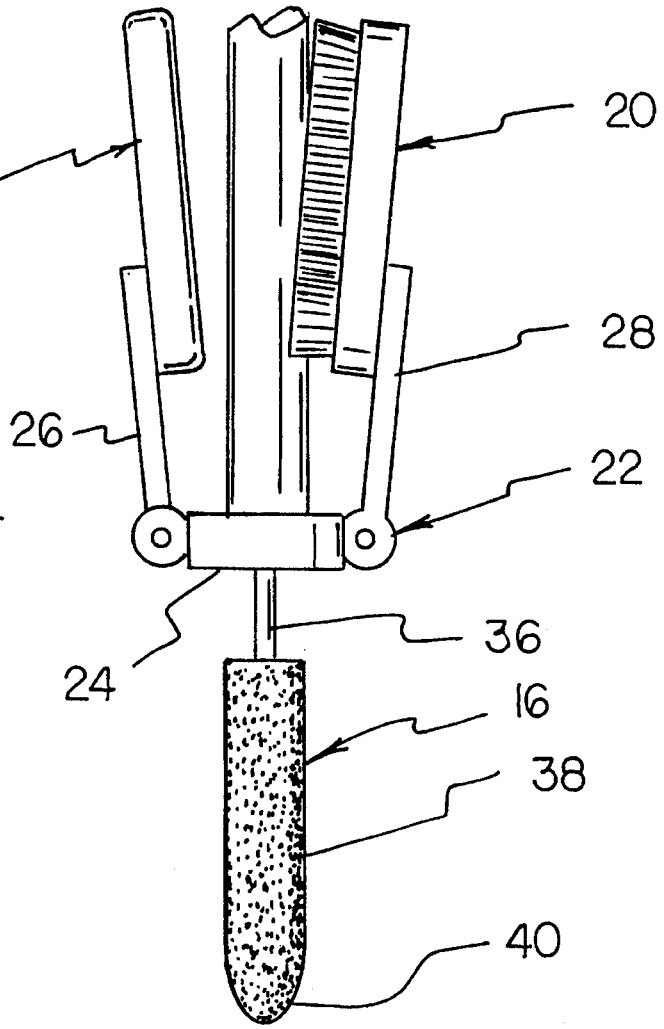
FIG. 4 is an elevation view of the portion of the present invention in a second position.
Figure 5:
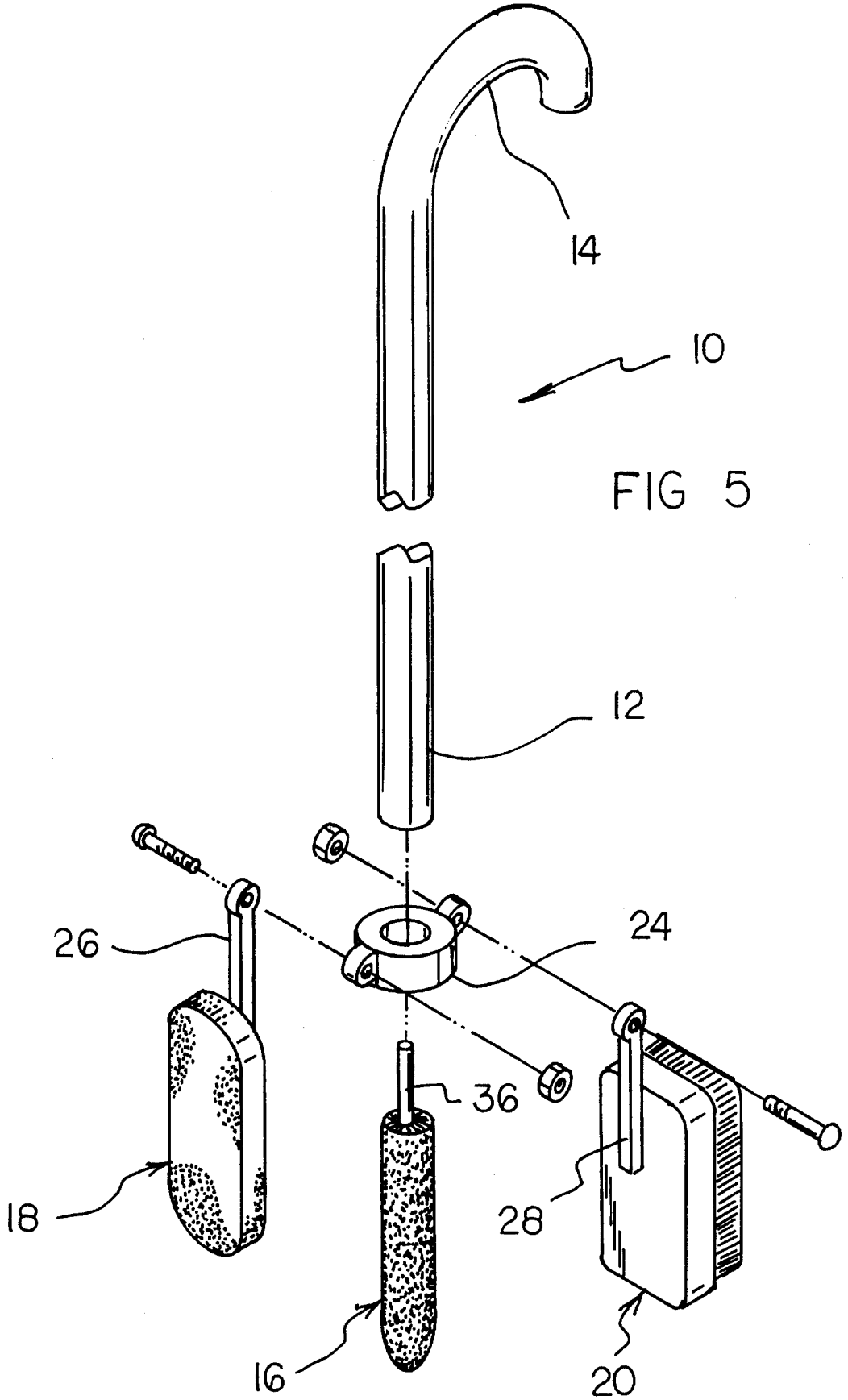
FIG. 5 is an exploded isometric illustration of the present invention.

As best illustrated in FIG. 2, it can be shown that the abrasion pad 18 preferably comprises a planar pumice stone 30 or other similarly coarse block of material which is secured to the outer end of the first arm 26. The planar brush 20 comprises a base plate 32 secured to an outer end of the second arm 28, with a plurality of bristles 34 extending substantially orthogonally from the base plate 32 for engagement with an exterior surface of a human foot during use of the device 10. As shown in FIG. 4, the cylindrical brush 16 preferably comprises a mounting rod 36 received and secured within an unillustrated cylindrical bore directed longitudinally into the lower end of the elongated handle 12. The mounting rod 36 can be secured relative to the elongated handle 12 by a frictional engagement therewith, adhesive engagement or mechanical fastening means as deemed desirable during construction of the present invention 10. The mounting rod 36 projects colinearly from the elongated handle 12 and includes a plurality of radially projecting bristles 38 extending substantially orthogonally outwardly therefrom. The radial bristles 38 are of a predetermined and constant length along a majority of the mounting rod 36 and decrease in length towards a free distal end of the mounting rod 36 so as to define a tapered end 40 of the cylindrical brush 16.

In use, the foot care shower brush 10 of the present invention can be easily utilized to clean various portions of a human foot during a shower or the like. The pivotal mounting of the abrasion pad 18 of the planar brush 20 permit the device 10 to be configured for convenient use of either one of the cylindrical brush 16, the planar brush 20, or the abrasion pad 18.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A foot care shower brush comprising:

an elongated handle for being grasped and manually manipulated by an individual;

a cylindrical brush projecting from a lower end of the elongated handle, the cylindrical brush comprises a soft and flexible mounting rod extending from the lower end of the elongated handle, the mounting rod projecting colinearly from the elongated handle and including a plurality of radially projecting nylon bristles substantially outwardly therefrom, the radial bristles being of a predetermined and constant length along a majority of a length of the mounting rod and decrease in length towards a free distal end of the mounting rod so as to define a tapered end of the cylindrical brush;

an abrasion pad and a planar brush both being pivotally mounted to the lower end of the elongated handle for cleaning exterior portions of a human foot, the abrasion pad and the planar brush both being pivotally mounted to the lower end of the elongated handle by a pivotal mounting means the pivotal mounting means comprised a mounting boss secured to the lower end of the elongated handle, a first arm pivotally mounted to the mounting boss and extending therefrom to couple with the abrasion pad, a second pivoting arm pivotally mounted to the mounting boss in a diametrically opposed orientation relative to the first arm, the second arm extending from the mounting boss to couple with the planar brush, wherein either and both of the abrasion pad and the planar brush can be pivoted below the lower end of the elongated handle for use during a cleaning procedure, and further wherein either and both of the abrasion pad and the planar brush can be pivoted above the lower end of the handle, the abrasion pad comprises a coarse block of material secured to an outer end of the first arm, the coarse block of material comprises a pumice stone, the planar brush comprises a base plate secured to an outer end of the second arm, and a plurality of bristles extending substantially orthogonally from the base plate; and a suspension hook mounted to an upper end of the elongated handle.

* * * * *